US011373824B2

(12) United States Patent
Galletti et al.

(10) Patent No.: US 11,373,824 B2
(45) Date of Patent: Jun. 28, 2022

(54) GAS-INSULATED HIGH OR MEDIUM VOLTAGE CIRCUIT BREAKER

(71) Applicant: Hitachi Energy Switzerland AG, Baden (CH)

(72) Inventors: Bernardo Galletti, Nussbaumen (CH); Valeria Teppati, Otelfingen (CH); Emmanouil Panousis, Baden (CH); Angelos Garyfallos, Nierderrohrdorf (CH); Branimir Radisavljevic, Zürich (CH); Joerg Lehmann, Basel (CH); Christoph Reutlinger, Bern (CH); Daniel Over, Klingnau (CH); Patrick Stoller, Fällanden (CH)

(73) Assignee: Hitachi Energy Switzerland AG, Baden (CH)

( * ) Notice: Subject to any disclaimer, the term of this patent is extended or adjusted under 35 U.S.C. 154(b) by 60 days.

(21) Appl. No.: 16/772,635

(22) PCT Filed: Dec. 21, 2018

(86) PCT No.: PCT/EP2018/086636

§ 371 (c)(1),
(2) Date: Jun. 12, 2020

(87) PCT Pub. No.: WO2019/122353

PCT Pub. Date: Jun. 27, 2019

(65) Prior Publication Data

US 2021/0375567 A1 Dec. 2, 2021

(30) Foreign Application Priority Data

Dec. 22, 2017 (EP) ..... 17210549

(51) Int. Cl.
*H01H 33/53* (2006.01)
*H01H 33/70* (2006.01)

(52) U.S. Cl.
CPC ..... *H01H 33/7015* (2013.01); *H01H 33/53* (2013.01)

(58) Field of Classification Search
CPC .... H01H 33/7015; H01H 33/53; H01H 33/56; H01H 33/565; H01H 33/60; H01H 33/64;
(Continued)

(56) References Cited

U.S. PATENT DOCUMENTS 4,471,187 A 9/1984 Sturzenegger et al.
5,153,397 A 10/1992 Seki
(Continued)

FOREIGN PATENT DOCUMENTS

CN 88103437 A 12/1988
CN 1042445 A 5/1990
(Continued)

OTHER PUBLICATIONS

International Search Report and Written Opinion of the International Searching Authority, PCT/EP2018/086633, dated Mar. 8, 2019, 10 pages.
(Continued)

*Primary Examiner* — William A Bolton
(74) *Attorney, Agent, or Firm* — Sage Patent Group

(57) ABSTRACT

The present disclosure provides a gas-insulated high or medium voltage circuit breaker including a first arcing contact and a second arcing contact, wherein at least one of the two arcing contacts is axially movable along a switching axis, wherein during a breaking operation, an arc between the first arcing contact and the second arcing contact is formed in an arcing region; a nozzle including a channel directed to the arcing region, for blowing an arc-extinguishing gas to the arcing region during the breaking operation; a diffuser portion adjacent to the nozzle, for transporting the gas from the arcing region to a region downstream of the
(Continued)

diffuser portion; a buffer volume directly downstream of the diffuser portion; and an enclosure confined within a housing of the circuit breaker.

15 Claims, 3 Drawing Sheets

(58) Field of Classification Search
CPC ..... H01H 33/7023; H01H 33/703; H01H 33/7038; H01H 33/7046; H01H 33/95; H01H 33/91; H01H 2033/902; H01H 2033/906; H01H 2033/908; H02B 1/26
USPC .. 218/53, 57, 59, 60–64, 66, 68, 69, 72, 73, 218/79, 80
See application file for complete search history.

(56) References Cited

U.S. PATENT DOCUMENTS

| | | | | |
|---|---|---|---|---|
| 5,898,149 | A | 4/1999 | Berger | |
| 6,717,791 | B1 * | 4/2004 | Wiesinger | H01H 33/7015 218/106 |
| 7,022,922 | B2 * | 4/2006 | Nowakowski | H01H 33/88 200/12 |
| 7,732,727 | B2 | 6/2010 | Saxl | |
| 8,063,335 | B2 * | 11/2011 | Grieshaber | H01H 33/98 218/157 |
| 8,389,886 | B2 * | 3/2013 | Dahlquist | H01H 33/74 218/59 |
| 8,410,388 | B2 * | 4/2013 | Kriegel | H01H 33/901 218/66 |
| 8,546,716 | B2 | 10/2013 | Nufer | |
| 9,058,947 | B2 | 6/2015 | Yaginuma | |
| 9,251,981 | B2 * | 2/2016 | Cernat | H01H 33/58 |
| 2011/0163069 | A1 | 7/2011 | Ohlsson | |
| 2013/0168357 | A1 * | 7/2013 | Yaginuma | H01H 33/901 218/57 |
| 2014/0190938 | A1 | 7/2014 | Tsukushi | |
| 2014/0209568 | A1 | 7/2014 | Cernat et al. | |
| 2014/0251957 | A1 | 9/2014 | Cernat et al. | |
| 2015/0194280 | A1 * | 7/2015 | Uchii | H01H 33/91 218/52 |
| 2016/0307716 | A1 * | 10/2016 | Florez | H01H 33/22 |
| 2018/0226214 | A1 | 8/2018 | Kotsuji | |

FOREIGN PATENT DOCUMENTS

| | | | |
|---|---|---|---|
| CN | 1118107 | A | 3/1996 |
| CN | 1143257 | A | 1/2002 |
| CN | 1700380 | A | 11/2005 |
| CN | 101828242 | A | 9/2010 |
| CN | 101174760 | A | 5/2011 |
| CN | 101006539 | A | 10/2012 |
| CN | 104662634 | A | 5/2015 |
| CN | 106710960 | A | 5/2017 |
| CN | 1259753 | A | 7/2020 |
| EP | 0701264 | A1 | 3/1996 |

OTHER PUBLICATIONS

Search Report and Opinion of the European Patent Office, EP 17210547.0, dated Jun. 27, 2018, 4 pages.
Search Report and Opinion of the European Patent Office, EP 17210549.6, dated Jun. 18, 2018, 7 pages.
International Preliminary Examination Report, PCT/EP2018/086633, dated Jun. 23, 2020, 8 pages.
International Preliminary Examination Report, PCT/EP2018/086636, dated Jun. 23, 2020, 7 pages.
International Search Report and Written Opinion of the International Searching Authority, PCT/EP2018/086636, dated Mar. 6, 2019, 9 pages.
First Office Action, Chinese Patent Application No. 201880079520.2, dated Oct. 11, 2021, 12 pages.

* cited by examiner

GAS-INSULATED HIGH OR MEDIUM VOLTAGE CIRCUIT BREAKER

CROSS REFERENCE TO RELATED APPLICATIONS

This application is a 35 U.S.C. § 371 national stage application of PCT International Application No. PCT/EP2018/086636 filed on Dec. 21, 2018, which in turns claims foreign priority to European Patent Application No. 17210549.6, filed on Dec. 22, 2017, the disclosures and content of which are incorporated by reference herein in their entirety.

FIELD

Embodiments of the present disclosure relate generally to a gas-insulated circuit breaker for breaking or interrupting high or medium voltages, and in particular to a circuit breaker with increased resilience against arc re-ignition.

BACKGROUND

Circuit breakers are well known in the field of medium and high voltage breaking applications. They are predominantly used for interrupting a current, when an electrical fault occurs. As an example, circuit breakers have the task of opening contacts and keeping them apart from one another in order to avoid a current flow even in case of high electrical potential originating from the electrical fault itself. The circuit breaker, may break medium to high short circuit currents of 1 kA to 80 kA at medium to high voltages of 15 kV to 72 kV and up to 1200 kV. The operation principle of circuit breakers is known.

Such circuit breakers are arranged in the respective electrical circuits which are intended to be interrupted based on some predefined event occurring in the electrical circuit. Generally, operation of such circuit breakers are responsive to detection of a fault condition or fault current. On detection of such a fault condition or fault current, a mechanism may operate the circuit breaker so as to interrupt the current flowing there through, thereby interrupting the current flowing in the electrical circuit. Once a fault is detected, contacts within the circuit breaker separate in order to interrupt the electrical circuit. Often spring arrangements, pneumatic arrangements or some other means utilizing mechanically stored energy are used to separate the contacts. Some of the energy required for separating the contacts may be obtained from the fault current itself. When interrupting the current flowing in the electrical circuit, an arc is generally generated. This arc must be cooled so that it becomes quenched or extinguished, such that the gap between the contacts repeatedly can withstand the voltage in the electrical circuit. It is known to use, air, oil or insulating gas as dielectric insulation and arc extinction medium in which the arc forms. Insulating gas comprises for example Sulphur hexafluoride (SF6) or $CO_2$.

However, after the arc has been extinguished a late restrike may occur. In particular, gas that is ejected downstream from the nozzle during the arcing phase may not diffuse entirely to volumes leading to the external insulator. In such a case, a late restrike may occur, if heated gas flows back to the gap between the contacts, e.g. the arcing zone or arcing region. For example, in the case of a long arcing time in the duties with large values of short circuit currents, e.g. values around 31 kA or 40 kA, the hot gas may remain trapped relatively close to the arcing zone and can expand back towards it after a current zero event, when the outflow of gas, for example through a compression volume and a heating volume, has stopped. Due to the increased temperature of the heated gas, the gas can have decreased dielectric strength, which would decrease the insulating properties of the gas. If the dielectric strength of the gas is decreased in the arcing zone, the arc can reignite.

The phenomenon or the flow reversal of hot gas back to the arcing region can have its largest magnitude in the case of long arcing times. The reason can be that in a long arcing time (symmetrical) shot, an extra back-heating cycle can take place due to the partial half wave of the current. The heating volume is then emptied, when the current crosses the second-to-last zero. As a consequence, the gas present in the heating volume at the beginning of the last back-heating process can be less dense than it would be in the case of a shot with only one back-heating cycle. Therefore, under the same energy input conditions, the gas is heated up to higher temperatures, thereby making the occurrence of a late restrike more likely.

While increasing the heating or compression volume and/or possibly even the drive energy might help to reduce the risk of late restrikes, these measures could be either difficult to implement and/or could also increase the costs and may be too expensive.

Thus, there is a need for alternative means for reducing the risk of late restrikes. In particular, there is a need for addressing late restrikes in a low-cost way and/or in a way that is easy to implement.

In particular, there is a need to improve the dielectric withstand of gas-insulated circuit breaker, such as gas-insulated high-voltage current breakers. Further, there is a need to decrease the tendency of heated gas to flow back to the arcing zone.

Furthermore, it would be beneficial to achieve a reduction of the temperature of the gas downstream of the arcing zone, so that gas that may flow back to the arcing zone has a lower temperature.

SUMMARY OF THE INVENTION

An object of the invention is to provide an improved gas-insulated high or medium voltage circuit breaker for reliable arc extinction while still maintaining at least to some extent a relatively low-cost design.

In light of the above, a gas-insulated high or medium voltage circuit breaker is provided. Further, a method of operating a gas-insulated high or medium voltage circuit breaker is provided. Aspects, benefits, and features of the present disclosure are apparent from the claims, the description, and the accompanying drawings.

According to one aspect, a gas-insulated high or medium voltage circuit breaker is provided. The gas-insulated high or medium voltage circuit breaker includes a first arcing contact and a second arcing contact, wherein at least one of the two arcing contacts is axially movable along a switching axis, wherein during a breaking operation, an arc between the first arcing contact and the second arcing contact is formed in an arcing region. The gas-insulated high or medium voltage circuit breaker further includes a nozzle including a channel directed to the arcing region, for blowing an arc-extinguishing gas to the arcing region during the breaking operation. The gas-insulated high or medium voltage circuit breaker further includes a diffuser portion adjacent to the nozzle, which serves for transporting the gas from the arcing region to a region downstream of the diffuser portion. The gas-insulated high or medium voltage circuit breaker further includes a buffer volume directly downstream of the diffuser portion. The gas-insulated high or medium voltage circuit breaker further includes an enclosure confined within a housing of the circuit breaker, wherein the enclosure substantially surrounds the buffer volume circumferentially, and includes a buffer dividing member connected to the diffuser portion as to divide the buffer volume into a first and a second buffer sub-volume, wherein the buffer dividing member has one or more apertures allowing a flow of gas between the first and the second buffer sub-volume through the buffer dividing member.

According to a further aspect, a method of operating a gas-insulated high or medium voltage circuit breaker is provided. The method includes breaking an electric current with the gas-insulated high or medium voltage circuit breaker according to aspects and embodiments described herein.

BRIEF DESCRIPTION OF THE DRAWINGS

For a more detailed understanding of the above recited features of the present disclosure, a more particular disclosure is given which makes reference to embodiments and accompanying drawings.

DETAILED DESCRIPTION OF EMBODIMENTS

Figure 1:
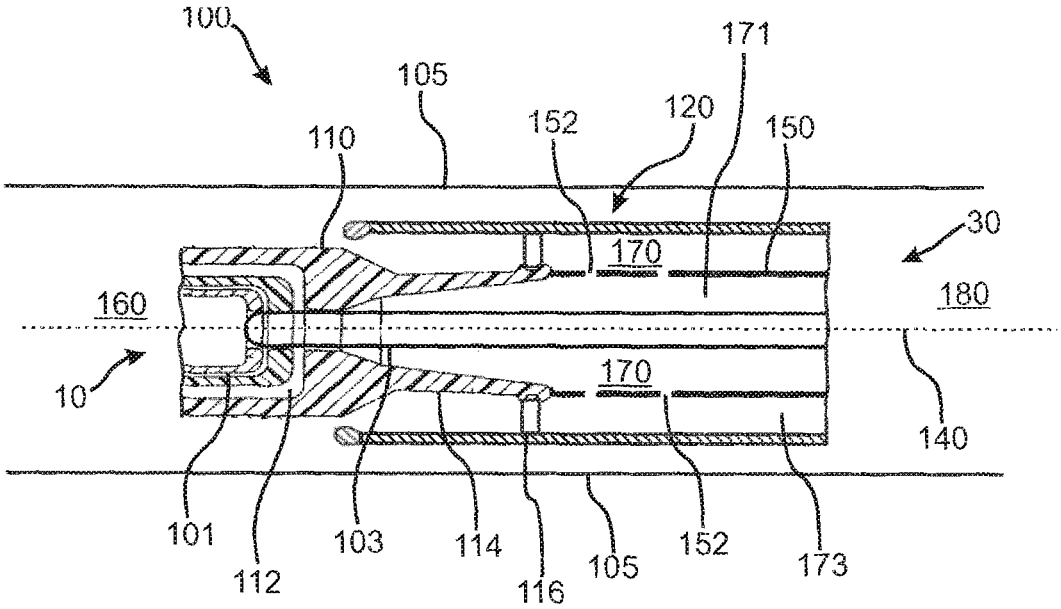
FIGS. 1 and 2 schematically show a gas-insulated high or medium circuit breaker according to a first embodiment described herein.

Reference is now made in detail to the various embodiments of the disclosure, one or more examples of which are illustrated in the figures. Within the following description of the drawings, the same reference numbers refer to same components. Generally, only the differences with respect to individual embodiments are described. Each example is provided by way of explanation of the disclosure and is not meant as a limitation of the disclosure. Further, features illustrated or described as part of one embodiment can be used on or in conjunction with other embodiments to yield yet a further embodiment. It is intended that the description includes such modifications and variations.

Although the following description is given with respect to a gas-insulted circuit breaker, and particularly with respect to a gas-insulated high or medium voltage circuit breaker for medium and high voltage applications, it is to be understood that the embodiments of the present disclosure are not limited thereto. Instead, the present embodiments could be applied anywhere where a gas-insulated circuit breaker is needed.

For simplicity, embodiments described herein often refer to a circuit breaker, instead of referring to a gas-insulated high or medium circuit breaker. The circuit breaker may be a puffer type circuit breaker, a self-blast circuit breaker, a combined puffer-assisted self-blast circuit breaker, a generator circuit breaker, a disconnector, a combined disconnector and circuit breaker, a live tank breaker, or a load break switch in power transmission and distribution systems.

The term high or medium voltage relates to voltages that exceeds 1 kV. A medium voltage preferably concerns nominal voltages in the range from 12 kV to 72 kV (medium voltage range), like 25 kV, 40 kV or 60 kV. A high voltage preferably relates to nominal voltages in the range from 72 kV to 550 kV, like 145 kV, 245 kV or 420 kV. Nominal currents of the circuit breaker can preferably be in the range from 1 kA to 5 kA. The current which flows during the abnormal conditions in which the circuit breaker performs its duty may be interchangeably referred to as the breaking current or the short circuit current. The short circuit current may be in the range from 31.5 kA to 80 kA, which is termed high short-circuit current duty. In low short-circuit current duties, the breaking current is typically larger than the nominal current and smaller than 0.3 times the rated short-circuit current, e.g. at most 24 kA. During a breaking operation, breaking voltages may be very high, e.g. in the range from 110 kV to 1200 kV.

The term "axial" designates an extension, distance etc. in the direction of the axis of the circuit breaker. An axial separation between parts means that these parts are separated from each other when seen or measured in the direction of the axis. The term "radial" designates an extension, distance etc. in a direction perpendicular to the axis of the circuit breaker. The term "cross-section" means a plane perpendicular to the axis, and the term "cross-sectional area" means an area in such a plane. The axis can be, for example, the switching axis.

A circuit breaker can include a nominal contact or nominal current path. As used herein, an electrical contact through which the nominal current passes, i.e. a nominal current path, is called a nominal contact, and the combination of the nominal contact and an arcing contact is called henceforth "breaker contact". As used herein, at least one of the breaking contacts moves relatively with respect to the other breaker contact. That is to say, at least one of the breaker contacts is moving.

In a gas-insulated circuit breaker, the arc-extinguishing medium comprises a gas. In embodiments, the circuit breaker includes an encapsulating housing which defines a volume for the gas. According to some embodiments, the circuit breaker can include a gas blowing system configured to extinguish an arc formed between a first arcing contact and a second arcing contact of the circuit breaker during a stage of the current interruption operation.

The circuit breaker contacts are typically adapted for electrically interconnecting the circuit breaker to the electrical circuit to be protected. According to embodiments herein, a medium voltage is a voltage of at least about 12 kV or higher up to and including 72 kV. A high voltage as used herein relates to nominal voltages of higher than about 72 kV. According to some embodiments, the high voltage can be a voltage of at least about 123 kV or at least 145 kV or higher.

The circuit breaker may include one or more components such as, a puffer-type cylinder, a self-blast chamber, a pressure collecting space, a compression space, or puffer volume, and an expansion space. The circuit breaker may effectuate interruption of the electrical circuit by means of one or more of such components, thereby discontinuing flow of electrical current in the electrical circuit, and/or extinction of the arc produced when the electrical circuit is interrupted.

The circuit breaker can include also other parts such as a drive, a controller, and the like, which have been omitted in the Figures. These parts are provided in analogy to a conventional high or medium voltage gas-insulated circuit breaker.

Figure 2:
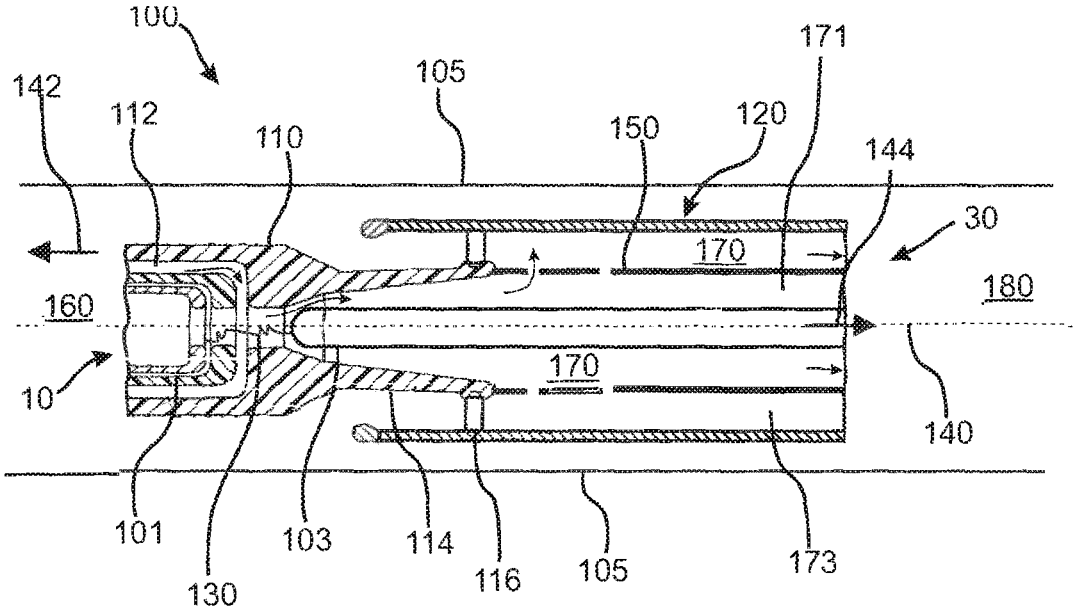

A gas-insulated circuit breaker 100 according to embodiments described herein, for high or medium voltages, is shown in FIG. 1 and FIG. 2. The circuit breaker 100 includes a first arcing contact 101 and a second arcing contact 103. The first arcing contact 101 is in FIG. 1 exemplarily in the form of a tulip, e.g. a contact tulip. As exemplarily shown in FIG. 1 the second arcing contact 103 is in the form of a rod, e.g. a contact rod. The two arcing contacts 101 and 103 co-operate with each other between an open end-position, in which the two arcing contacts 101 and 103 are completely electrically or galvanically separated from each other, and a closed end-position, in which an electric current can pass between them or in which they are in physical contact with one another.

The first acing contact 101 can for example be part of a first breaking contact 10 having a first nominal contact, which is for simplicity not illustrated in FIG. 1 and FIG. 2. Further, the second arcing contact 102 can be part of a second breaking contact 30 with a second nominal contact.

The first and the second arcing contacts 101, 103 are constituted in a manner such that they can conveniently carry an interruption current, so that the arcing contacts do not generate excessive heating and withstand the heat of an arc generated during a current interruption operation of the circuit breaker 100. In particular, arcing contacts are made of any suitable material, typically arc-resistant material, that enables the circuit breaker 100 to function as described herein, such as exemplarily, but not limited to: copper, copper alloys, silver alloys, tungsten, tungsten alloys, or any combination(s) thereof. In particular, these materials are chosen on the basis of their electrical conductivity, hardness (i.e. resistance to abrasive wear), mechanical strength, low cost, and/or chemical properties. For example, the contact rod shown in FIGS. 1 and 2 and forming the second arcing contact 103 is made of any suitable conductive material which enables the circuit breaker 100 to function as described herein, such as exemplarily, but not limited to, copper. If required, the contact rod may be made of different materials; for example, different parts thereof may be made of different materials or may be coated with a material which provides adequate electrical and/or mechanical properties to each of these parts.

As indicated by the arrows 142, 144 in FIG. 2, at least one of the first and the second arcing contact 101, 103, e.g. as part of the first breaking contact 10 and the second breaking contact 30, respectively, is movable relatively to the other one along a switching axis 140 to bring the arcing contacts in the open end-position or in the closed end-position.

In the closed end-position, the second arcing contact 103 is inserted into the first arcing contact 101. During the breaking operation, the first arcing contact 101 relatively moves away from the second arcing contact 103 so that both contacts separate from one another. During the breaking operation, as shown in FIG. 2, an arc 130 develops in the arcing region between portions of the first and second arcing contact 101, 103.

The circuit breaker 100 shown in FIGS. 1 and 2 is arranged in a gas-tight housing 105, as for example a gas-tight housing, filled with an electrically insulating gas or arc-extinguishing gas. The volume between the housing 105 and the components of the circuit breaker 100 shown in FIGS. 1 and 2 is indicated by reference numeral 180. This will also be referred to as an "outer volume" 180, which is a volume inside the gas-tight housing 105. The gas-tight housing can be constituted as an encapsulation 105, such as, but not limited to, a metallic or ceramic housing. Such gas-tight encapsulation 105 can be mounted on a suitable structure.

The circuit breaker 100 further includes a nozzle 110 having a channel 112 directed to the arcing region. In other words, the channel 112 or blowing channel 112 or heating channel 112 is directed to the arc 130. The nozzle 110 serves as a blowhole for blowing the arc-extinguishing gas to the arcing region during the breaking operation. Thereby, the arc 130 can be extinguished or quenched.

The nozzle 110 includes a diffuser portion 114. In embodiments, the arc-extinguishing gas for blowing out the arc 130 is provided in a volume upstream 160 of a diffuser portion 114. For example, the volume upstream 160 of the diffuser 114 can be filled with a dielectric gas, such as in embodiments $CO_2$, $SF_6$ or $SF_6$ and its known mixtures, such as $N_2$ or $CF_4$. In further embodiments, also alternative insulating or arc-extinguishing gases are possible, as described below.

The diffuser portion 114 can be adjacent, in the axial direction, to the nozzle 110. The cross-sectional area of the diffuser portion 114 may increase in the axial direction away from the nozzle 110. The diffuser portion 114 may form a diverging duct for the flow of the arc-extinguishing gas. Accordingly, the arc-extinguishing gas from the volume upstream 160 of the diffuser 114 is transported from the arcing region to a region downstream of the diffuser 114.

The region downstream of the diffuser 114 includes a buffer volume 170 provided directly downstream of the diffuser 114. Accordingly, after the arc-extinguishing gas has passed through the arcing region and the diffuser 114, the arc-extinguishing gas reaches the buffer volume 170. The term "buffer volume directly downstream of the diffuser" as used herein can be understood as in direct fluid communication with the arcing region.

In FIGS. 1 and 2, the enclosure 120 is confined within the housing 105 of the circuit breaker. The enclosure 120 substantially surrounds the buffer volume 170 circumferentially. That is to say, the enclosure 120 can substantially delimit the outermost radial extent of the buffer volume 170. The enclosure 120 has tube-like shape in FIGS. 1 and 2.

As exemplarily shown in FIG. 1 and FIG. 2, the enclosure 120 is movable relatively to the first breaking contact 10 along the switching axis 140. Accordingly, also the second breaking contact 30 is relatively movable to the first breaking contact 10. From FIG. 1 to FIG. 2, the second breaking contact 30 moves relatively to the first breaking contact 10 from left to right.

The circuit breaker 100 further includes a buffer dividing member 150. As shown in FIGS. 1 and 2, the buffer dividing member 150 is connected to the diffuser portion 114 as to divide the buffer volume 170 into a first buffer sub-volume 171 and a second buffer sub-volume 173. The buffer dividing member 150 can be connectable to the diffuser portion 114 by suitable connecting means. In some embodiments, the buffer dividing member 150 can be connected to a portion of the nozzle 110.

Due to the connection to the diffuser portion 114, the buffer dividing member 150 can move together with the components including the first breaking contact 10, the nozzle 110, and the diffuser portion 114, relatively with respect to the gas-tight housing or encapsulation 105 during a breaking operation, i.e. when first and the second arcing contacts 101, 103 are separated.

As indicated by reference numeral 152, the buffer dividing member 150 has one or more apertures 152. Thereby, a flow of gas is allowed between the first and the second buffer sub-volume 171, 173 through the buffer dividing member 150. One or more apertures 152 can for example be provided along a circumference of the enclosure 120. The gas flow path is indicated in FIG. 2 by arrows having no reference sign.

By dividing the buffer volume 170, the dimension of the buffer volume 170 can be effectively decreased. In particular, the arc-extinguishing gas heated by the arc can be transported more effectively away from the arcing region. By the decreased cross-section of the buffer volume 170, the conditions established therein can lead to an increased velocity of the flow of heated arc-extinguishing gas, which can increase the efficiency of the gas being transported to an exhaust provided downstream. Therefore, the tendency of hot gas flowing back to the arcing region can be decreased. Due this, the likelihood of late restrikes can be decreased or late restrikes can even be prevented.

According to embodiments of the present disclosure, which can be combined with embodiments described herein, the buffer dividing member 150 can be connected to a ring-like portion (216, see FIG. 3) of the diffuser portion 114. The ring-like portion can be at and end portion of the diffuser portion 114. For example, the ring-like portion can be a nozzle ring 216 or a metallic ring portion 216 coated with a ceramic material. The buffer dividing member 150 may be securely connected to the diffuser portion 114 via the nozzle ring 216.

In some embodiments, the ring-like portion is connectable to a transmission mechanism of a gear system for providing a relative movement between the first and the second arcing contact.

According to embodiments of the present disclosure, which can be combined with embodiments described herein, the buffer dividing member 150 can be a coaxially arranged shell extending along an axial length of the buffer volume 170. For example, the shell can extend between a first axial end and a second axial end. According to embodiments, the buffer dividing member 150 can be a perforated shell, in particular, a perforated cylindrical shell.

According to embodiments of the present disclosure, which can be combined with embodiments described herein, the circuit breaker can include a gear system operatively coupled to at least one of the first or second arcing contact and the nozzle for providing a relative movement, i.e. a translation, along the switching axis. In embodiments, at least a portion of the gear system is arranged at a supporting structure. In some embodiments, the circuit breaker is a single motion circuit breaker. That is to say, only one of the first and second arcing contact is movable along the switching axis. In other embodiments, the circuit is a double motion circuit breaker. In other words, both of the first and the second arcing contact are movable along the switching axis.

In the embodiment shown in FIGS. 1 and 2, the buffer dividing member 150 is provided as two half-cylindrical shells extending from a front portion of the diffuser portion 114 along an axial length in direction of the switching axis to an (not shown) end portion of the circuit breaker 100. The end portion can be for example the abovementioned supporting structure. The two half-cylindrical shells may pass axially through the supporting structure. The supporting structure can for example have two slits through which the respective half-cylindrical shell may pass.

In FIGS. 1 and 2, the enclosure 120 is provided slidable with respect to the nozzle ring 216.

According to an embodiment of the present disclosure, the buffer dividing member 150 can be substantially disc-shaped, such as e.g. a disc-shaped metal plate. In particular, the buffer dividing member 150 can be formed as a disc that substantially extends radially. The disc can have the one or more apertures 152. For example, the disc can be perforated.

Figure 3:
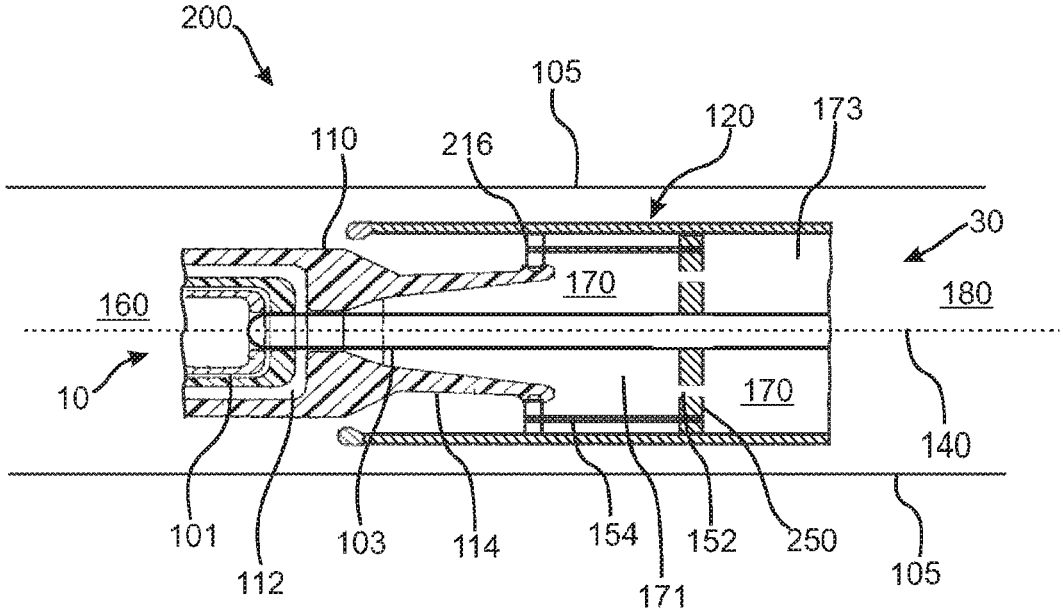
FIGS. 3 and 4 schematically show a gas-insulated high or medium circuit breaker according to a second embodiment described herein.

In some embodiments, the cross-sectional area of the one or more apertures provided on the buffer dividing member and in particular on the buffer dividing member having a substantially disc-shape can be in a range of about 20% to 45% of the total cross-sectional surface of the buffer dividing member (see FIG. 1, 2: 150; and FIG. 3, 4: 250).

More particularly, the cross-sectional area of the one or more apertures may be 37% of the total cross-sectional surface of the buffer dividing member. The cross-sectional area of the one or more apertures 152 may be described as the "fluid cross-sectional area". The area that is obtained when the fluid cross-sectional area is subtracted from total cross-sectional area may be then described as the "solid cross-sectional area".

In some embodiments of the present disclosure, in particular when the buffer dividing member is substantially disc-shaped, the total cross-sectional surface of the buffer dividing member 150 or 250 can be in a range of about 80 $cm^2$ to 160 $cm^2$. More particularly, the total cross-sectional surface of the buffer dividing member 150 or 250 may be about 100 $cm^2$ to 140 $cm^2$. If the total cross-sectional is surface is for example about 124.69 $cm^2$, the fluid cross-sectional area would be about 45.89 $cm^2$, and the solid cross-sectional area would be about 78.80 $cm^2$.

According to some embodiments, the second arcing contact can pass slideably through a center portion of the buffer dividing member. In particular, when the buffer dividing is disc-shaped, the buffer dividing member can have a cutout through which the second arcing contact, e.g. the contact rod, passes.

Figure 4:
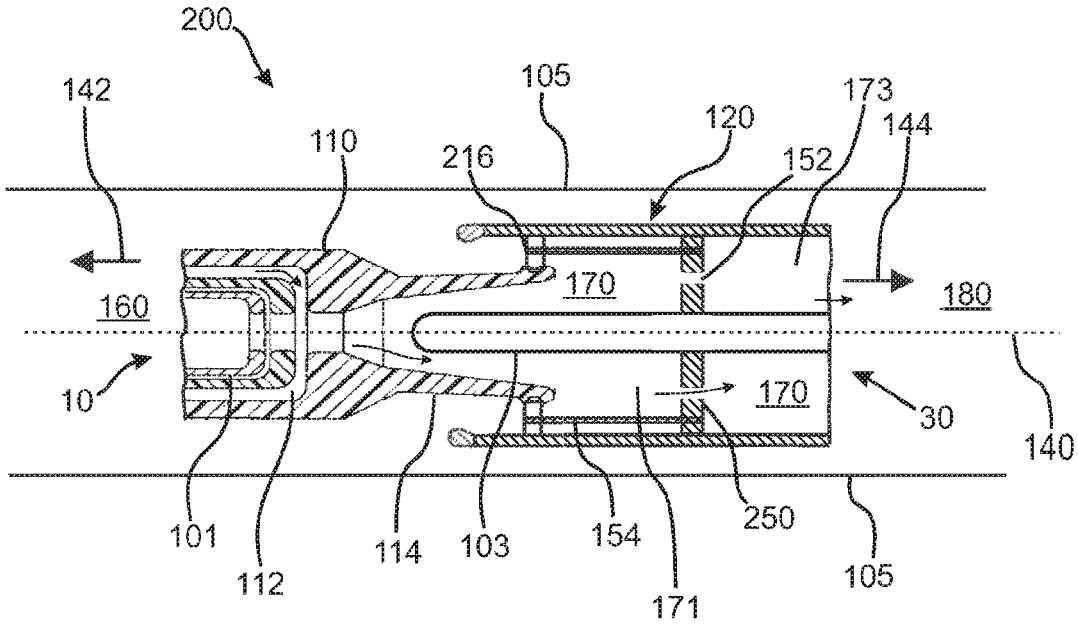

FIGS. 3 and 4 show a circuit breaker 200 according to a further embodiment of the present disclosure. The circuit breaker 200 of FIGS. 3 and 4 is similar to the circuit breaker 100 of FIGS. 1 and 2, and only the differences will be discussed in the following.

In the FIGS. 3 and 4, the buffer dividing member is formed as a cylindrical plate 250 having one or more apertures 152 through which a gas can flow from the first buffer sub-volume 171 to the second buffer sub-volume 173. The cylindrical plate 250 guides the second arcing contact 103 during an axial movement of the second arcing contact 103. Further, the cylindrical plate 250 is provided slideable on the inner surface of the enclosure 120.

According to embodiments of the present disclosure the buffer dividing member can substantially extend from one end of the buffer volume to another end of the buffer volume. For example, the buffer dividing member 150 can extend from one axial end to another axial end of the buffer volume 170, as exemplarily shown in FIGS. 1 and 2. Alternatively, the buffer dividing member 250 can extend from one radial outermost end of the buffer volume 170 to an opposite radial outermost end of the buffer volume 170, as exemplarily shown in FIGS. 3 and 4. In other words, the buffer dividing member 250 can extend radially through the buffer volume 170.

Again in some embodiments, the cross-sectional area of the one or more apertures provided on the buffer dividing member 250 and in particular on the buffer dividing member 250 having a substantially disc-shape can be in a range of about 20% to 45% of the total cross-sectional surface of the buffer dividing member 250.

According to embodiments of the present disclosure, which can be combined with embodiments described herein, the buffer dividing member can be formed as a sheet. In particular, the buffer dividing member can be a metal sheet. For example, the buffer dividing member can be made of two half-cylindrical metal sheets. Alternatively, the buffer dividing can be a cylindrical disc, in particular, a cylindrical metal disc.

The circuit breaker 200 further includes a nozzle ring 216 provided on an axial end portion of the diffuser portion 114. The cylindrical plate 250 is connected fixedly to the diffuser portion 114 via the nozzle ring 216. In particular, the cylindrical plate 250 and the nozzle ring 216 are connected by one or more connecting rods 154. Accordingly, the cylindrical plate 250 can be moved relatively to the enclosure 120 in an axial direction together with the first breaking contact 101. During a breaking operation, the dimension, i.e. the volume, of first buffer sub-volume 173 stays substantially constant.

FIG. 3 shows the circuit breaker 200 in a stage during the breaking process, at which the first and the second arcing contacts 101, 103 are still in electrical contact. FIG. 4 shows the circuit breaker 200 in a stage corresponding to an open position. Yet, the volume of the first buffer sub-volume has substantially the same size in both stages. By this, the velocity and density of a flow of the arc-extinguishing gas from the arcing region to the buffer volume 170, and from the buffer volume 170 to the exhaust downstream at an end portion of the circuit breaker 200 can be increased. Thereby the temperature in the arcing region and the buffer volume 170 after a current zero event, e.g. after an arc has been extinguished, a current has been interrupted, can be decreased. Accordingly, the risk of a late restrike, i.e. a re-ignition of the arc, can be decreased or late restrikes can even be avoided.

In computational fluid dynamics simulations, it has been shown that connecting the buffer dividing member, e.g. the cylindrical plate 250, to the diffuser portion 114 and thereby dividing the buffer volume 170 into a first and a second buffer sub-volume 171, 173, in particular a constant first buffer sub-volume 171, during the breaking operation when the first and the second arcing contacts 101, 103 are separated, can effectively decrease the average temperature in the arcing region after a current zero event. In particular, the average temperature in the arcing region is decreased due to a reduced flow reversal of heated arc-extinguishing gas back to the arcing region.

According to embodiments of the present disclosure, during the breaking operation, the arc-extinguishing gas can flow from the arcing region via the first sub-volume 171 of the buffer volume 170 to the second sub-volume 173. Further, from the second sub-volume 173, the arc-extinguishing gas can be then released to an exhaust at a side of the buffer volume 170 axially further remote from the arcing region.

According to embodiments of the present disclosure, which can be combined with embodiments described herein, at least a part of the enclosure can be formed as a portion of a nominal current path and the buffer dividing member (e.g. 150, 250) is slideable along an inner surface of the enclosure. FIGS. 3 and 4 exemplarily show the enclosure 120 formed as a nominal contact, i.e. as a portion of a nominal current path or upper current carrier, of the second breaking contact 30. In a closed position of the circuit breaker, the nominal contact of the second breaking contact contacts a nominal contact of the first breaking contact.

As the arc-extinguishing gas is heated by the arc during the arc quenching process, the heated gas that flows from the arcing zone to the first buffer sub-volume and, via the one or more apertures provided on the buffer dividing member, to the second buffer sub-volume. As the effective volume of the buffer volume can be decreased by this, the transport of heated gas to an exhaust of the circuit breaker provided at an end axial end portion can be made more efficient. By this, the temperature of the arc-extinguishing gas in the buffer volume can be decreased. Accordingly, also the probability or risk of a restrike or late restrike, i.e. a re-ignition of the arc, due to a flow reversal of heated gas from the buffer volume back to the arcing zone, can be decreased. In other words, when the volume upstream 160 of the diffuser has been drained, the gas that moves through the second breaker contact back towards the nozzle is cooler and poses less of a threat with respect to re-ignition of the arc.

According to embodiments of the present disclosure, which can be combined with embodiments described herein the enclosure can be an electrically conductive metal pipe.

According to some embodiments of the present disclosure, which can be combined with embodiments described herein, an arc-extinguishing system for extinguishing the arc can be integrated in the volume upstream 160 of the nozzle. The arc-extinguishing system can have a pressurizing system (puffer system). The pressurizing system can for example include a pressurizing chamber (puffer chamber) having a quenching gas contained therein. The quenching gas is a portion of the insulation gas contained in the housing volume 180 (outer volume) of the circuit breaker 100. The pressurizing chamber can be delimited by a chamber wall and a piston for compressing the quenching gas within the pressurizing chamber during the current breaking operation. To this purpose, the piston moves jointly with the first arcing contact 101 so that the piston pressurizes the quenching gas within the pressurizing chamber when the first arcing contact 101 is moved away from the second contact 103 for opening the circuit breaker.

In embodiments, the nozzle 110 is adapted for blowing the pressurized quenching gas, e.g. the arc-extinguishing gas, from the volume upstream 160 onto the arc 130 formed during the current breaking operation. The nozzle can include an inlet connected to the pressurizing chamber for receiving the pressurized quenching gas from the pressurizing chamber, and a nozzle outlet to the arcing region. The nozzle 10 is in some embodiments made of an electrically insulating material, as for example, PTFE. In some embodiments, the nozzle 110 can comprises a ring portion attached at one of its ends.

During the breaking operation (i.e. the circuit-breaking process), the nominal contacts (not shown) are separated from each other and the first and second arcing contacts 101 and 103 then also separate from each other after a delay period, to form an electric arc 130 that is extinguished by blowing the gas through the nozzle 110.

In some embodiments, the electric arc is extinguished during a zero crossing of the current by a flow of insulating gas which is blown away from the volume upstream of the diffuser, e.g. a heating volume of a self-blast circuit breaker or a compression volume of a puffer-type circuit breaker, towards the arcing region and to an exhaust volume.

According to some embodiments of the present disclosure, the circuit breaker includes a supporting structure provided at an end of the circuit breaker in the downstream direction. In some embodiments, the second arcing contact is formed as a plug-like rod. The plug-like rod may have at its end portion, in the downstream direction, a plate-like supporting structure. The plate-like supporting structure can be connected to the second arcing contact, e.g. the plug-like rod, or may be inherently formed with the second arcing contact. The supporting structure may be connected to the gear system. Accordingly, when a second breaker contact is formed as a movable breaking contact, the supporting structure and the second arcing contact can be moved together.

The present disclosure further relates to a method of operating a gas-insulated high or medium voltage circuit breaker. In particular, an electric current with a high or medium voltage circuit breaker according to embodiments described herein can be interrupted. Thereby, a circuit breaker can reliably interrupt a current, e.g. a fault current, and a late re-strike can be more safely prevented.

Figure 5:
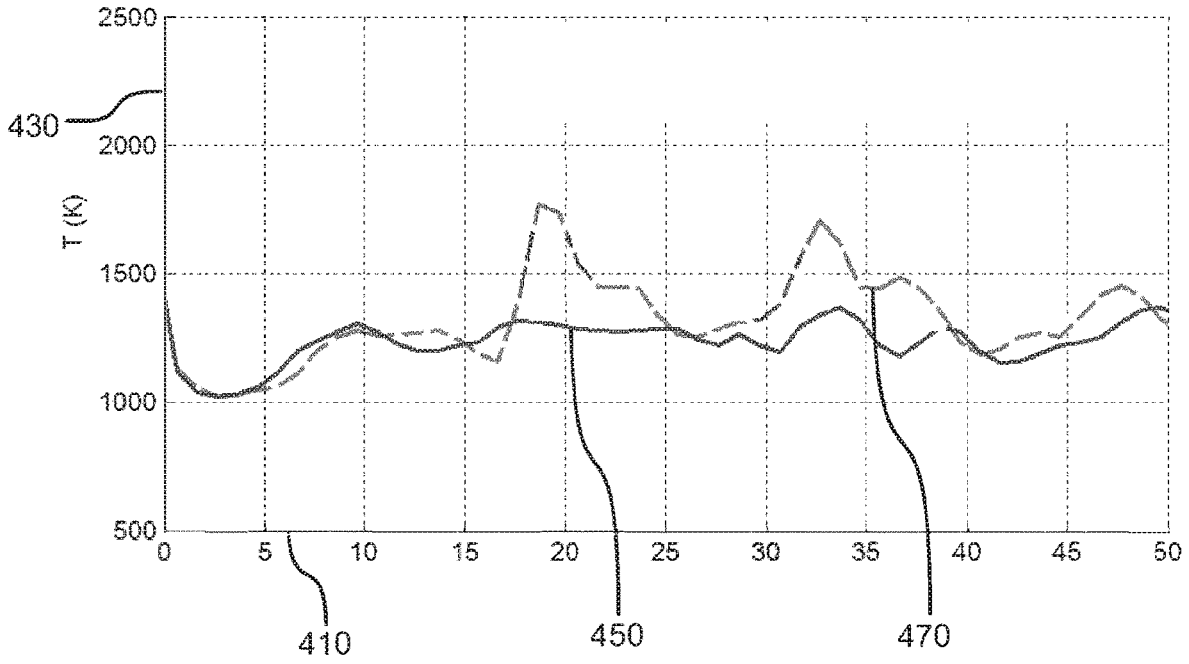
FIG. 5 is a chart comparing the temperature of the gas in the arcing region of a gas-insulated high or medium circuit breaker according to embodiments described herein with the temperature in the arcing region of a conventional circuit breaker.

FIG. 5 is a graph illustrating a result of a computational fluid dynamics simulation for comparing the circuit breaker according to embodiments described herein and a conventional circuit breaker. FIG. 5 shows the averaged gas temperature in units of Kelvin in the arcing region (vertical axis 430) as a function of time. The averaged gas temperature in the arcing region is the temperature in a control volume delimited radially by the nozzle's throats and axially by the plug tip and tulip tip. The units of the horizontal axis 410 are given in milliseconds. At time 0 ms at the horizontal axis 410, a current zero event (CZ), such as the interruption of the current or extinguishing of the arc, occurs. Graph 450 (solid line) shows the time course of the temperature of the circuit breaker according to embodiments described herein. Graph 470 (dashed line) shows a conventional circuit breaker. In the conventional circuit breaker, at about 18.7 ms after the CZ, the temperature reaches a peak value. At the peak value of graph 470, the temperature may be already high enough to deteriorate the insulating properties of the arc-extinguishing gas which can lead to an electrical breakdown such that an arc can re-ignite. The temperature increase in graph 470 can be related to a flow reversal of hot gas after the CZ. At about 32.5 ms after CZ, a further peak value in graph 470 is observable.

In contrast, in the circuit breaker according to embodiments described herein (graph 450), the temperature in the arcing zone stays relatively constant after the CZ and no sharp increase is observable. Thus, a significant reduction of the peak values of the averaged arcing region temperature can be achieved. Accordingly, the flow reversal of the heated gas to the arcing region can be reduced or can even be eliminated. Thereby, the risk of arc re-ignition and late re-strikes is reduced and arc re-ignition and late re-strikes may even be avoided.

In embodiments of the present disclosure, the circuit breaker can further include a gas blast system configured to apply a gas blast on an arc formed between first arcing contact 101 and the second arcing contact 103 during a stage of a current interruption operation, in the arcing region located in the nozzle 110. The gas blast system may include any suitable structure, configuration, arrangement, and/or components that enable to extinguish an electric arc between the arcing contacts. For example, but not limited to, the gas blast system may include appropriate valves, blast pistons, nozzles, arc heaters, and at least one pressure chamber for the self-blast volume and/or for the compression volume. Further elements from known gas blasts systems with which a person of skill in the art will be familiar can be used with at least some of the embodiments described herein without this being described in more detail here.

The gas-insulated high or medium voltage circuit breaker according to embodiments described herein is preferably adapted to interrupt medium to high-voltages of 12 kV or more, 52 kV or more, or 145 kV or more.

In embodiments, the gas-insulated high or medium voltage circuit breaker can be one of a puffer-type circuit breaker or a self-blast circuit breaker, or a combination thereof.

In embodiments, the gas blasted by the gas blast system is any suitable gas that enables to adequately extinguish the electric arc formed between the arcing contacts during a current interruption operation, such as, but not limited, to an inert gas as, for example, sulphur hexafluoride $SF_6$. Thereby, the arc between the first and second arcing contacts 101, 103 develops in an arcing region.

For the purposes of this disclosure the fluid used in the circuit breaker can be $SF_6$ gas or any other dielectric insulation medium, may it be gaseous and/or liquid, and in particular can be a dielectric insulation gas or arc quenching gas. Such dielectric insulation medium can for example encompass media comprising an organofluorine compound, such organofluorine compound being selected from the group consisting of: a fluoroether, an oxirane, a fluoroamine, a fluoroketone, a fluoroolefin, a fluoronitrile and mixtures and/or decomposition products thereof. Herein, the terms "fluoroether", "oxirane", "fluoroamine", "fluoroketone", "fluoroolefin" and "fluoronitrile" refer to at least partially fluorinated compounds. In particular, the term "fluoroether" encompasses both hydrofluoroethers and perfluoroethers, the term "oxirane" encompasses both hydrofluorooxiranes and perfluorooxiranes, the term "fluoroamine" encompasses both hydrofluoroamines and perfluoroamines, the term "fluoroketone" encompasses both hydrofluoroketones and perfluoroketones, the term "fluoroolefin" encompasses both hydrofluoroolefins and perfluoroolefins, and the term "fluoronitrile" encompasses both hydrofluoronitriles and perfluoronitriles. Some embodiments provide that the fluoroether, the oxirane, the fluoroamine the fluoroketone and the fluoronitrile are fully fluorinated, i.e. perfluorinated.

In embodiments, the dielectric insulation medium is selected from the group consisting of: a hydrofluoroether, a perfluoroketone, a hydrofluoroolefin, a perfluoronitrile, and mixtures thereof.

In particular, the term "fluoroketone" as used in the context of the present invention shall be interpreted broadly and shall encompass both fluoromonoketones and fluorodiketones or generally fluoropolyketones. Explicitly, more than a single carbonyl group flanked by carbon atoms may be present in the molecule. The term shall also encompass both saturated compounds and unsaturated compounds including double and/or triple bonds between carbon atoms. The at least partially fluorinated alkyl chain of the fluoroketones can be linear or branched and can optionally form a ring.

In embodiments, the dielectric insulation medium comprises at least one compound being a fluoromonoketone and/or comprising also heteroatoms incorporated into the carbon backbone of the molecules, such as at least one of: a nitrogen atom, oxygen atom and sulphur atom, replacing one or more carbon atoms. More preferably, the fluoromonoketone, in particular perfluoroketone, can have from 3 to 15 or from 4 to 12 carbon atoms and particularly from 5 to 9 carbon atoms. Most preferably, it may comprise exactly 5 carbon atoms and/or exactly 6 carbon atoms and/or exactly 7 carbon atoms and/or exactly 8 carbon atoms.

In embodiments, the dielectric insulation medium comprises at least one compound being a fluoroolefin selected from the group consisting of: hydrofluoroolefins (HFO) comprising at least three carbon atoms, hydrofluoroolefins (HFO) comprising exactly three carbon atoms, trans-1,3,3,3-tetrafluoro-1-propene (HFO-1234ze), 2,3,3,3-tetrafluoro-1-propene (HFO-1234yf), and mixtures thereof.

In embodiments, the organofluorine compound can also be a fluoronitrile, in particular a perfluoronitrile. In particular, the organofluorine compound can be a fluoronitrile, specifically a perfluoronitrile, containing two carbon atoms, and/or three carbon atoms, and/or four carbon atoms. More particularly, the fluoronitrile can be a perfluoroalkylnitrile, specifically perfluoroacetonitrile, perfluoropropionitrile (C2F5CN) and/or perfluorobutyronitrile (C3F7CN). Most particularly, the fluoronitrile can be perfluoroisobutyronitrile (according to the formula (CF3)2CFCN) and/or perfluoro-2-methoxypropanenitrile (according to formula CF3CF(OCF3)CN). Of these, perfluoroisobutyronitrile (i.e. 2,3,3,3-tetrafluoro-2-trifluoromethyl propanenitrile alias i-C3F7CN) may provide low toxicity.

The dielectric insulation medium can further comprise a background gas or carrier gas different from the organofluorine compound (in particular different from the fluoroether, the oxirane, the fluoroamine, the fluoroketone and the fluoroolefin) and can in embodiments be selected from the group consisting of: air, $N_2$, $O_2$, $CO_2$, a noble gas, $H_2$; $NO_2$, NO, $N_2O$; fluorocarbons and in particular perfluorocarbons, such as $CF_4$; $CF_3I$, $SF_6$; and mixtures thereof. For example, the dielectric insulating gas can be $CO_2$ in an embodiment.

The circuit breaker can comprise also other parts such as nominal contacts, a drive, a controller, and the like, which have been omitted in the Figures and are not described herein in detail. These parts are provided in analogy to a conventional high or medium voltage gas-insulated circuit breaker.

Example embodiments of a circuit breaker and a method of operating a circuit breaker are described above in detail. The apparatus and methods are not limited to the specific embodiments described herein, but rather, components of the circuit breaker and/or steps of the methods may be utilized independently and separately from other components and/or steps described herein, and are not limited to practice with only a circuit breaker as described herein. Rather, the example embodiments can be implemented and utilized in connection with many other circuit breaker applications.

Although specific features of various embodiments of the invention may be shown in some drawings and not in others, this is for convenience only. In accordance with the principles of the invention, any feature of a drawing may be referenced and/or claimed in combination with any feature of any other drawing. In particular, the FIGS. 1 to 4 illustrate different aspects which may be combined with other general aspects of the present disclosure. Furthermore, method steps can be implemented as device features, and vice versa device features can be implemented as method steps.

This written description uses examples to disclose the invention, including the best mode, and also to enable any person skilled in the art to practice the invention, including making and using any devices or systems and performing any incorporated methods. While various specific embodiments have been disclosed in the foregoing, those skilled in the art will recognize that the spirit and scope of the claims allows for equally effective modifications. Especially, mutually non-exclusive features of the embodiments described above may be combined with each other. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A gas-insulated high or medium voltage circuit breaker comprising:

a first arcing contact and a second arcing contact, wherein at least one of the two arcing contacts is axially movable along a switching axis, wherein during a breaking operation, an arc between the first arcing contact and the second arcing contact is formed in an arcing region;

a nozzle including a channel directed to the arcing region, for blowing an arc-extinguishing gas to the arcing region during the breaking operation;

a diffuser portion adjacent to the nozzle, for transporting the arc-extinguishing gas from the arcing region to a region downstream of the diffuser portion;

a buffer volume directly downstream of the diffuser portion;

an enclosure confined within a housing of the circuit breaker, wherein the enclosure substantially surrounds the buffer volume circumferentially; and a buffer dividing member connected to the diffuser portion as to divide the buffer volume into a first and a second buffer sub-volume, wherein the buffer dividing member has one or more apertures allowing a flow of gas between the first and the second buffer sub-volume through the buffer dividing member, wherein the buffer dividing member is substantially disc-shaped and substantially extending radially.

2. The gas-insulated high or medium voltage circuit breaker according to claim 1, wherein the second arcing contact passes slideably through a center portion of the buffer dividing member.

3. The gas-insulated high or medium voltage circuit breaker according to claim 1, wherein a cross-sectional area of the one or more apertures provided on the buffer dividing member is in a range of 20% to 45% of a total cross-sectional surface of the buffer dividing member.

4. The gas-insulated high or medium voltage circuit breaker according to claim 1, wherein a total cross-sectional surface of the buffer dividing member is in a range of 80 $cm^2$ to 160 $cm^2$.

5. The gas-insulated high or medium voltage circuit breaker according to claim 1, wherein at least a part of the enclosure is formed as a portion of a nominal current path, and the buffer dividing member is slideable along an inner surface of the enclosure.

6. The gas-insulated high or medium voltage circuit breaker according to claim 1, wherein the buffer dividing member substantially extends from one end of the buffer volume to another end of the buffer volume.

7. The gas-insulated high or medium voltage circuit breaker according to claim 1, wherein the buffer dividing member is a coaxially arranged shell extending along an axial length of the buffer volume.

8. The gas-insulated high or medium voltage circuit breaker according to claim 1, wherein the circuit breaker is a gas-insulated circuit breaker adapted to interrupt medium to high-voltages of 12 kV or more, 52 kV or more, or more than 72 kV, or 145 kV or more.

9. The gas-insulated high or medium voltage circuit breaker according to claim 1, wherein the buffer dividing member is connected to a ring-like portion of the diffuser portion.

10. The gas-insulated high or medium voltage circuit breaker according to claim 1, wherein during the breaking operation, the arc-extinguishing gas flows from the arcing region via the first sub-volume of the buffer volume to the second sub-volume, wherein from the second sub-volume, the arc-extinguishing gas is released to an exhaust at a side of the buffer volume axially further remote from the arcing region.

11. The gas-insulated high or medium voltage circuit breaker according to claim 1, further comprising a gear system operatively coupled to the nozzle and the second arcing contact for providing a relative movement between the nozzle and the second arcing contact along the switching axis.

12. The gas-insulated high or medium voltage circuit breaker according to claim 1, wherein the gas-insulated high or medium voltage circuit breaker is a self-blast circuit breaker.

13. The gas-insulated high or medium voltage circuit breaker according to claim 1, wherein the buffer dividing member is formed as a sheet.

14. A method of operating the gas-insulated high or medium voltage circuit breaker, the method comprising:

breaking an electric current by the gas-insulated high or medium voltage circuit breaker according to claim 1.

15. The gas-insulated high or medium voltage circuit breaker according to claim 1, wherein the gas-insulated high or medium voltage circuit breaker comprises a puffer-type circuit breaker.

* * * * *